US006286733B1

(12) United States Patent
Francois

(10) Patent No.: US 6,286,733 B1
(45) Date of Patent: Sep. 11, 2001

(54) SLIDING VALVE DISPENSER WITH OVERCAP

(75) Inventor: James A. Francois, Evansville, IN (US)

(73) Assignee: Rexam Medical Packaging Inc., Evansville, ID (US)

( * ) Notice: Subject to any disclaimer, the term of this patent is extended or adjusted under 35 U.S.C. 154(b) by 0 days.

(21) Appl. No.: 09/661,523

(22) Filed: Sep. 13, 2000

Related U.S. Application Data

(60) Provisional application No. 60/156,787, filed on Sep. 30, 1999.

(51) Int. Cl.[7] ..... B67D 3/00
(52) U.S. Cl. ..... 222/525; 222/524
(58) Field of Search ..... 222/521, 524, 222/525

(56) References Cited

U.S. PATENT DOCUMENTS

| | | | | |
|---|---|---|---|---|
| 2,998,902 | * | 9/1961 | Thomas et al. | 222/525 |
| 3,599,845 | | 8/1971 | Miller . | |
| 4,826,055 | | 5/1989 | Stull . | |
| 5,230,447 | | 7/1993 | Kirk . | |
| 5,328,063 | | 7/1994 | Beck et al. . | |
| 5,465,876 | | 11/1995 | Crisei . | |
| 5,588,562 | | 12/1996 | Sander et al. . | |
| 5,603,436 | | 2/1997 | Leoncavallo et al. . | |
| 5,810,185 | | 9/1998 | Croesbeck . | |
| 6,024,255 | * | 2/2000 | Long, Jr. | 222/525 |

FOREIGN PATENT DOCUMENTS

| | | |
|---|---|---|
| 28 39 284 | 3/1980 | (DE) . |

* cited by examiner

*Primary Examiner*—Kevin Shaver
*Assistant Examiner*—Thach H Bui
(74) *Attorney, Agent, or Firm*—John F. Salazar; Middleton Reutlinger

(57) ABSTRACT

A push/pull type dispenser closure is provided by the present invention. The closure includes a cap body, slider valve and an overcap. The closure may be placed in the closed and sealed position by attaching the overcap to the cap body. The overcap includes an annular ring that engages the slider valve when the overcap is placed on the cap body, so as to ensure that the slider valve is forced into the closed and sealed position. The slider valve includes an annular seal with increased flexibility that provides for a more facile closing and sealing of the closure

29 Claims, 8 Drawing Sheets

SLIDING VALVE DISPENSER WITH OVERCAP

This application claims the benefit of U.s. Provisional Application No. 60/156,787 filed Sep. 30, 1999.

BACKGROUND OF THE INVENTION

1. Technical Field

This invention relates to a sliding valve dispenser with overcap used for dispensing liquids. More particularly, this invention relates to a novel seal and cover design for use in conjunction with a sliding valve push/pull type dispenser to reduce leakage.

2. Prior Art

Using push/pull dispenser systems to open and close closures is well known in the art of closures. However, current closures in the art often suffer measurable leakage due to either inadequate seals, or valves inadvertently remaining open after securing of an overcap to the closure. Thus, there is a need for a push/pull dispenser closure that will both easily seal when placed in the closed position and automatically close when an overcap is placed thereon.

SUMMARY OF THE INVENTION

It is an object of the present invention to provide a resealable push/pull dispenser closure for a container in order to reduce the amount of leakage from the closure when the user desires to close the container.

It is another object of the present invention to provide a push/pull dispenser closure that will close automatically when an overcap is attached to the cap body.

It is a further object of the present invention to provide a push/pull dispenser closure that is designed to reduce the occurrence of seal surface imperfections that prevent complete sealing of the closure.

It is yet another object of the present invention to provide a push/pull dispenser closure that requires less polymeric material and is more durable than other push/pull dispenser closures.

More particularly, the present invention is directed to a three-piece closure having a cap body, a slider valve and an overcap. The cap body includes an upwardly extending center post which is mounted axially by three spokes within a first axial opening of a neck. The spokes attach to the center post and extend to the side wall of the neck. The spokes attach to the neck at points that are non-adjacent to a neck sealing bead that projects outwardly from the neck. This nonalignment of the spokes and the neck sealing bead helps to reduce the occurrence of sinks in the seal. Sinks can occur in the neck of the sealing bead when heat from the molding process is retained with the adjacent plastic. Such sinks can create gaps between the sealing surfaces, thereby causing leaks. The frequency of the occurrence of sinks in the neck sealing bead can be reduced by limiting the amount of structural plastic which is adjacent the sealing surface. This limiting of the amount of plastic can be achieved by spacing the spokes away from the neck sealing bead. The reduction in the amount of plastic also provides for a thinner shell and a shallower bead, thereby accelerating the molding cycle and reducing the overall weight of the closure. The nonalignment of the spokes and the bead also provides more flexibility to the neck of the closure, so that when the bead is jumped by the slider valve the neck may flex inward, thereby reducing the potential for damage to the bead by its interaction with the slider valve.

The side wall of the neck of the cap body has an inner diameter which is larger than the outer diameter of the skirt of the center post, thereby providing space between the neck and the center post through which liquid may flow from the container when the dispenser is open. The neck side wall extends downward to a shoulder from which depends a neck skirt having threads internally formed thereon. On the inside surface of the cap body, where the shoulder and the neck skirt meet, an integral linerless seal projects inwardly therefrom. This linerless seal prevents fluid from leaking between the neck skirt of the cap body and the container finish. Further down the inside surface of the neck skirt is found a centering bead which contacts the container finish when the cap body is attached thereto. The centering bead assists in the alignment of the cap body relative to the container finish, thereby providing for the alignment of the cap body threads with the container finish threads. The neck skirt also has at least one helical thread, having a substantially flat upper thread surface, circumscribing its inner surface.

The slider valve includes a first top wall and a second skirt depending therefrom. A second axial opening is provided in a first top wall of the slider valve. The first top wall also has an annular seal depending therefrom. An annular trough is disposed within the bottom surface of the first top wall and circumscribes the annular seal. The annular trough provides more flexibility to the annular seal than would otherwise be available. Due to this increased flexibility, the annular seal can more easily engage the center post to form a seal when the slider valve is placed in the closed position. Thus, less force is required both to open and to close and seal the closure than would be needed in the absence of the trough. Additionally, the increased flexibility provides an enhanced seal that is suitable for pressurized products.

The overcap includes a second top wall with a third skirt depending therefrom. A second bead projects inwardly from the third skirt and engages the rib located on the cap body when the overcap is attached to the cap body. An annular ring depends from the second top wall. This annular ring engages the first top wall located on the slider valve when the overcap is attached to the cap body. This engagement of the annular ring and the slider valve ensures that the slider valve is in the closed and sealed position when the overcap is attached to the cap body. More particularly, due to the height of the overcap relative to the cap body, the slider valve must be in the closed position in order for the second bead of the overcap to snap over and engage the rib projecting from the cap body. As pressure is applied by the user to the overcap to attach it to the cap body, the annular ring engages the second top wall of the slider valve, thereby forcing the slider valve into the closed position. Due to the flexibility of the annular seal, a great deal of force is not necessary to close the slider valve. Therefore, once the second bead engages the rib on the cap body, the slider valve is necessarily in the closed and sealed position.

It will become apparent that other objects and advantages of the present invention will be obvious to those skilled in the art upon reading the detailed description of the preferred embodiment set forth hereinafter.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1A:
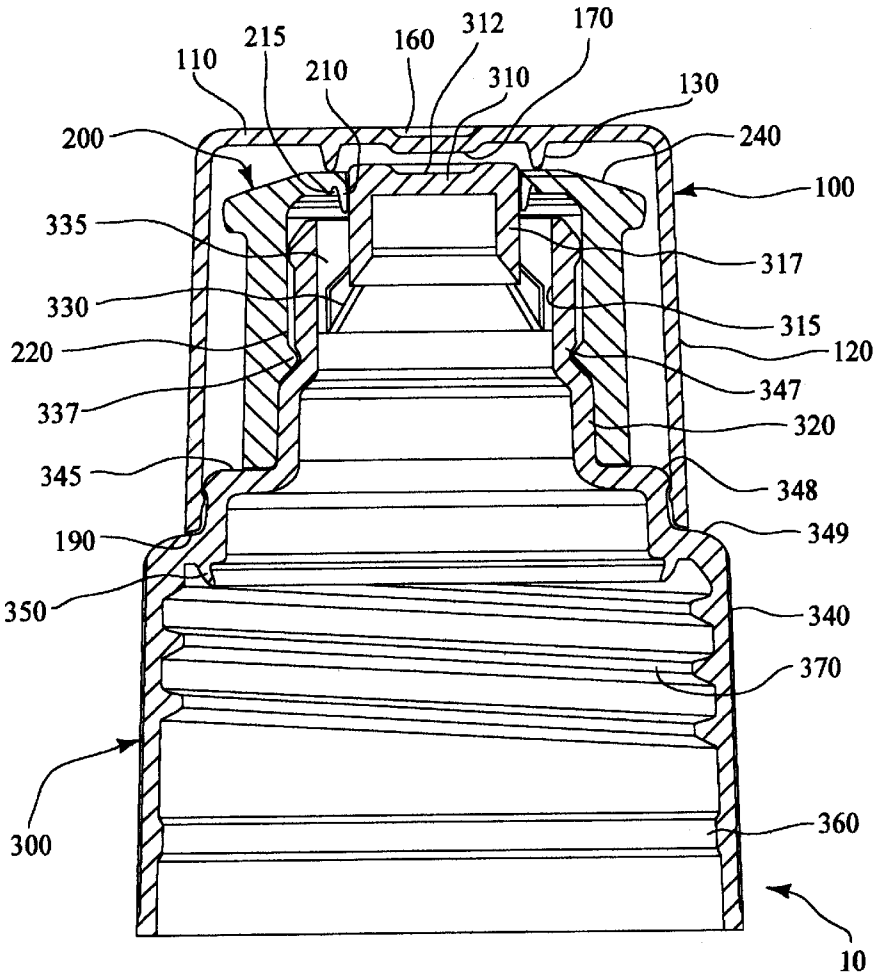
FIG. 1*a* is a cross-sectional view of the three-piece closure of FIG. 1.
Figure 1:
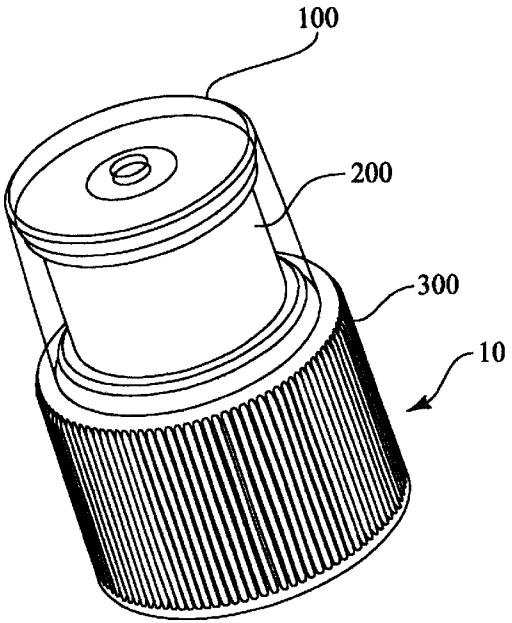
FIG. 1 is a perspective view of a three-piece closure of one preferred embodiment of the present invention.

As shown in FIGS. 1–4*b,* a three-piece push/pull type dispenser closure 10 includes an overcap 100, a slider valve 200, and a cap body 300. The slider valve 200 is movably engaged to the cap body 300. The overcap 100 may be attached to the cap body 300 by the engagement of a locking bead 140 projecting inwardly from the overcap 100 with a locking rib 348 extending outwardly from the cap body 300. As the overcap 100 is placed on the cab body 200, an annular ring 130 projecting from the overcap 100 engages the slider valve 200, thereby forcing the slider valve 200 down into a closed position on the cap body 300. The slider valve 200 is retained in a closed position on the cap body 300, thereby sealing the dispenser closure 10.

As shown in FIGS 1*a,* 2*a* and 2*b,* the cap body 300 includes an upwardly extending center post 310 which is mounted axially in the first axial opening of a neck 320. The neck 320 has a larger inner diameter than the outer diameter of the center post 310, thereby allowing liquid from the container, not shown, to flow between the neck 320 and the center post 310. The center post 310 is attached to the neck 320 by a plurality of spokes 330, which are integrally formed to the inner surface of the side wall 315 of the neck 320. A plurality of openings 335 are defined between the surfaces of spokes 330, side wall 315 and centerpost 310. A neck sealing bead 337 projects outwardly from the side wall 315 of neck 320. Spokes 330 are attached to the inner surface of the side wall 315 of neck 320 at points spaced longitudinally away from where neck sealing bead 337 projects outwardly from neck 320, as shown in FIGS. 2*b*–2*f*. The neck sealing bead 337 is provided in order to prevent fluid leaks between the cap body 300 and the slider valve 200, as is shown in contacting relationship in FIG. 1. The neck sealing bead 337 contacts a side wall 220 of slider valve 200.

The neck 320 is provided with a slider valve stopping shoulder 345. A first skirt 340 extends downwardly from shoulder 345 and ends with a terminating edge defining an open bottom end of cap body 300. The first skirt 340 has at least one thread 370 projecting inwardly therefrom. The shoulder 345 serves as a positive stop for the downward movement of the slider valve 200 onto the cap body 300 when closing the closure 10. At the junction of the base 349 of the neck 320 and the first skirt 340, an integral linerless seal 350 projects inwardly from the cap body 300. This linerless seal 350, prevents fluid from leaking past the junction where it contacts the container finish, not shown. A centering bead 360 projects inwardly from the cap body 300 at a side surface of the first skirt 340. This centering bead 360 facilitates the centering of the cap body 300 on the container finish. The centering bead 360 may mate with a corresponding bead on the container finish or may engage the container finish directly, thereby providing spacing of the cap body 300 from the container finish so that helical thread 370 is properly aligned with a corresponding thread on the container finish. Such proper alignment reduces the likelihood of cross-threading and fluid leakage. Helical thread 370, which has a substantially flat upper thread surface, circumscribes the inner surface of the skirt 340 and may threadably mate with a corresponding thread located on the container finish.

Figure 2B:
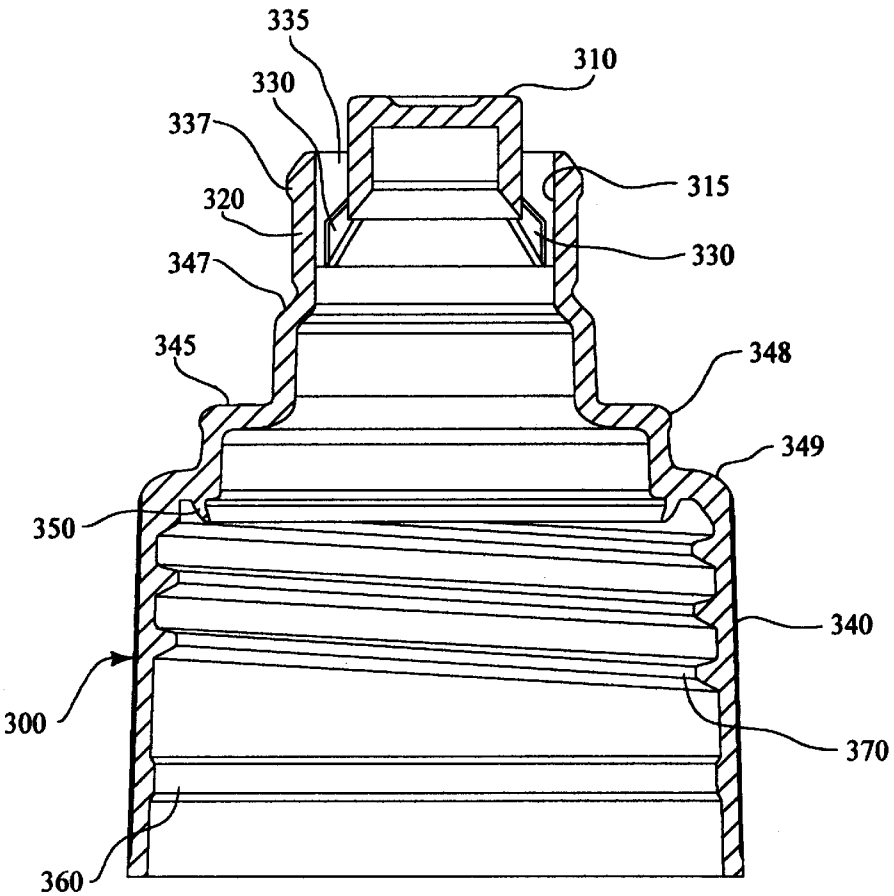
FIG. 2*b* is a cross-sectional view of a cap body of the three-piece closure of the present invention taken along line 2*b*—2*b* of FIG. 2*a*.
Figure 2A:
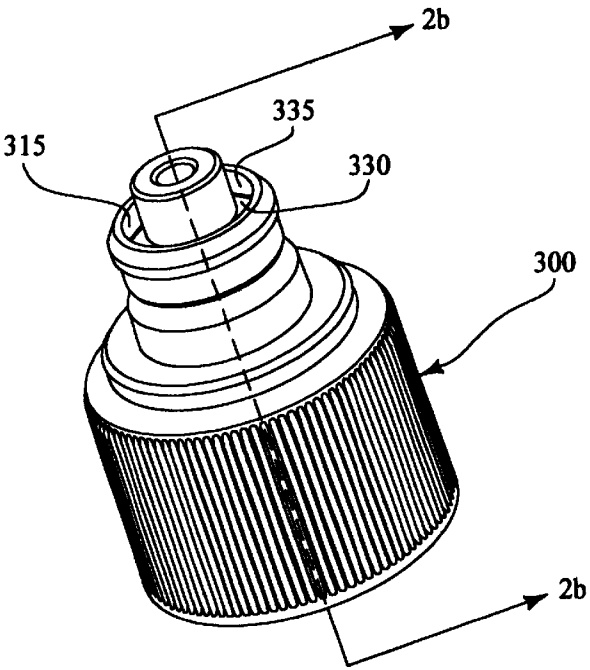
FIG. 2*a* is an upper perspective view of a cap body of the three-piece closure of the present invention.
Figure 2C:
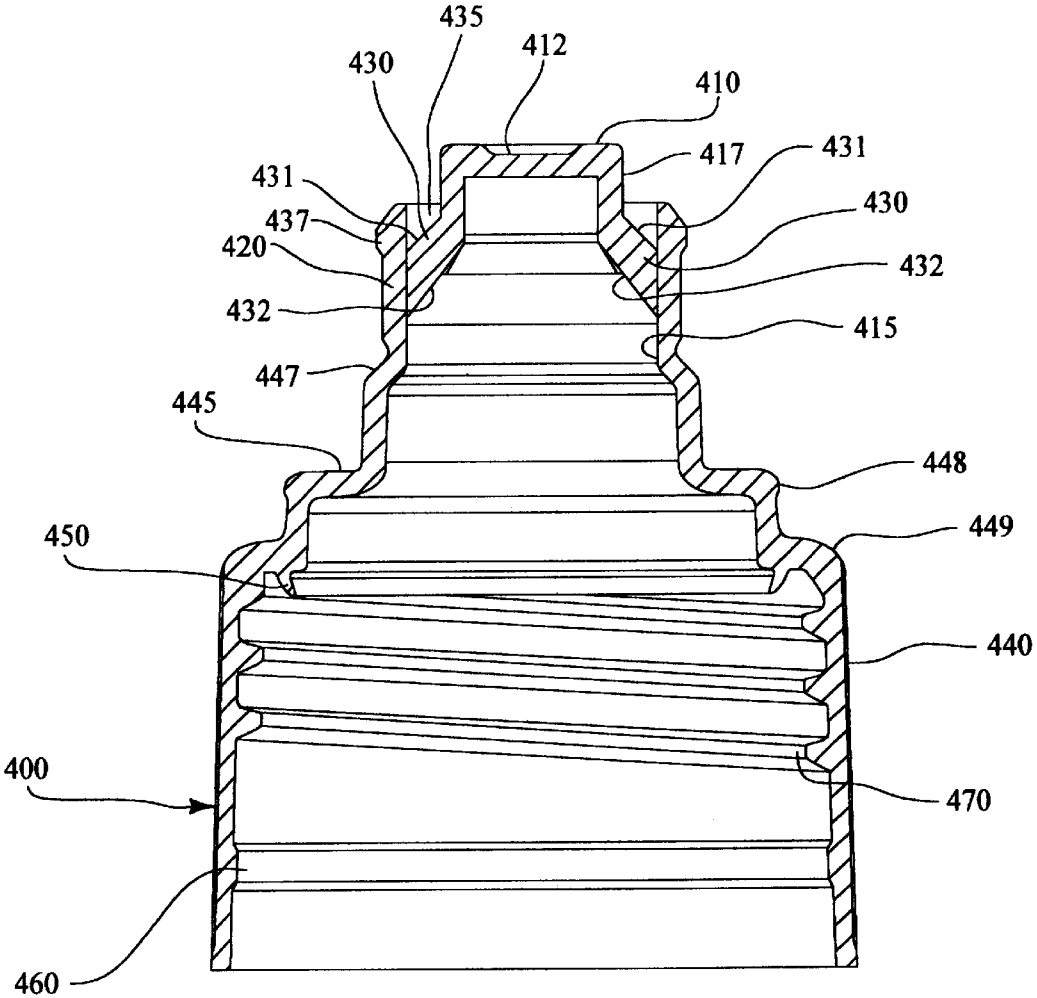
FIG. 2*c* is a cross-sectional view of another embodiment of the cap body of the three-piece closure of the present invention.
Figure 2D:
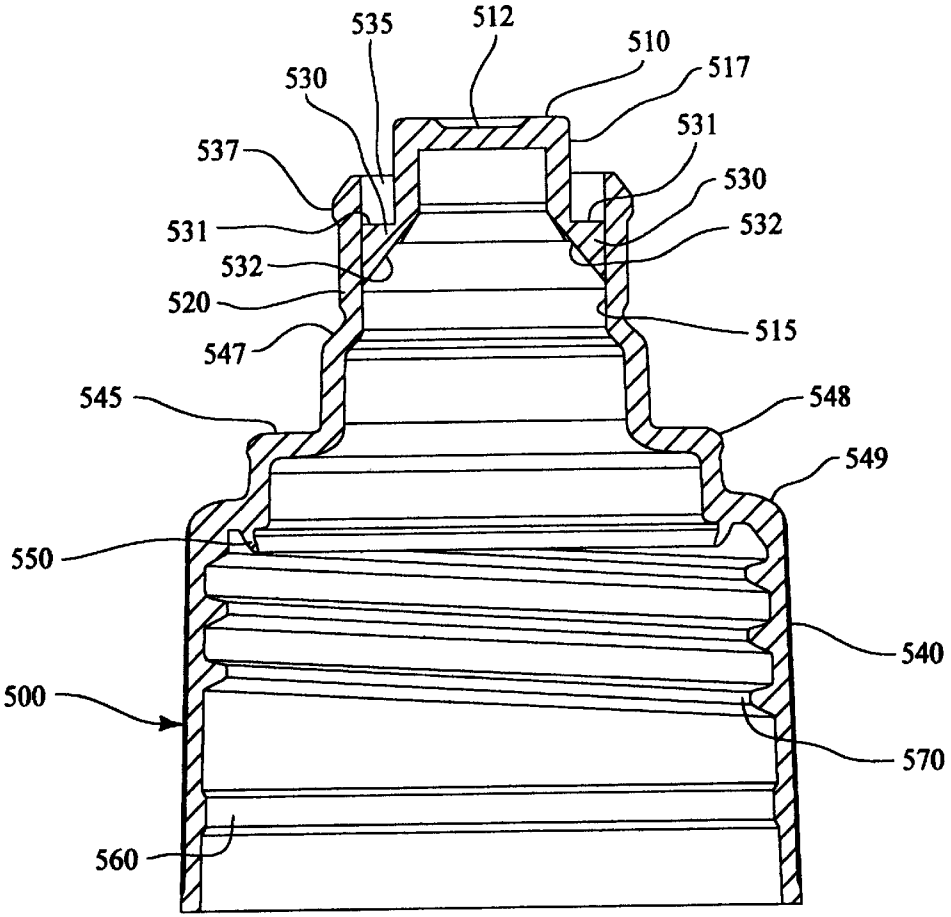
FIG. 2*d* is a cross-sectional view of a further embodiment of the cap body of the three-piece closure of the present invention.
Figure 2E:
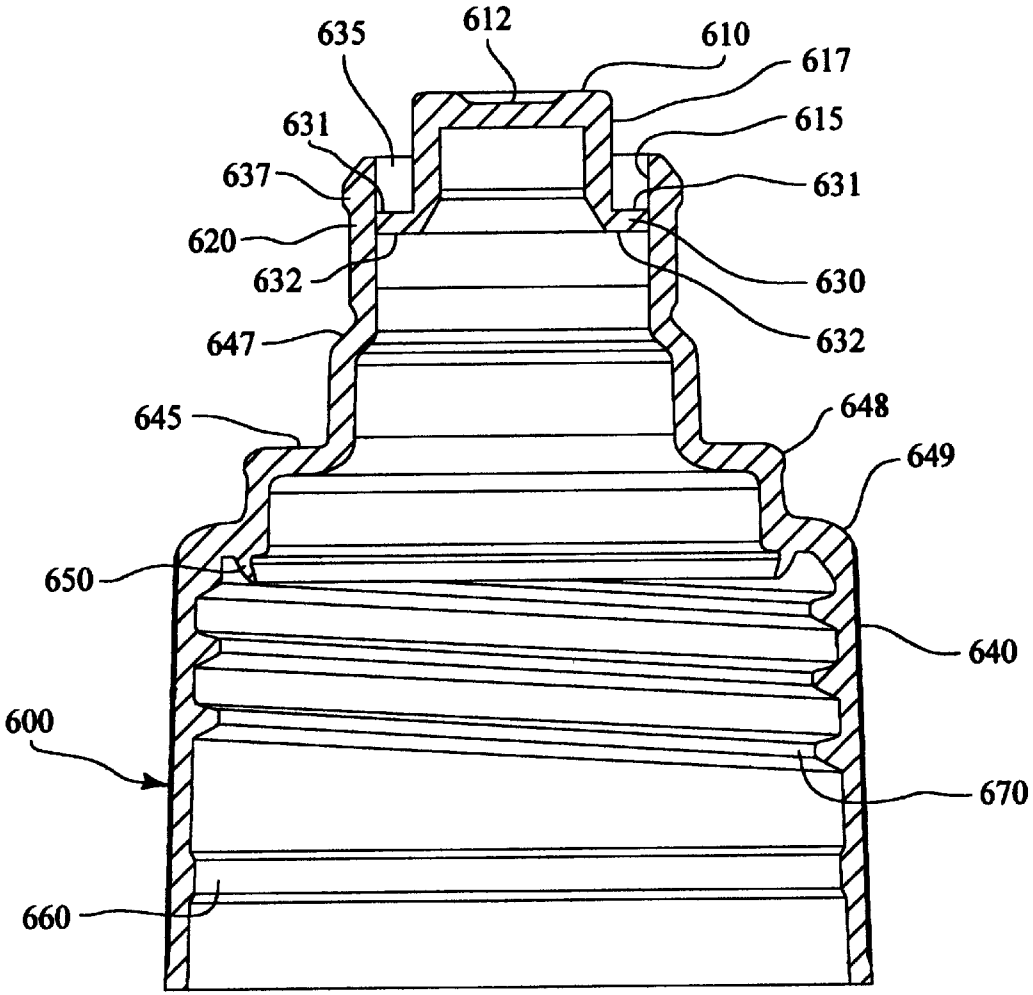
FIG. 2*e* is a cross-sectional view of yet another embodiment of the cap body of the three-piece closure of the present invention.
Figure 2F:
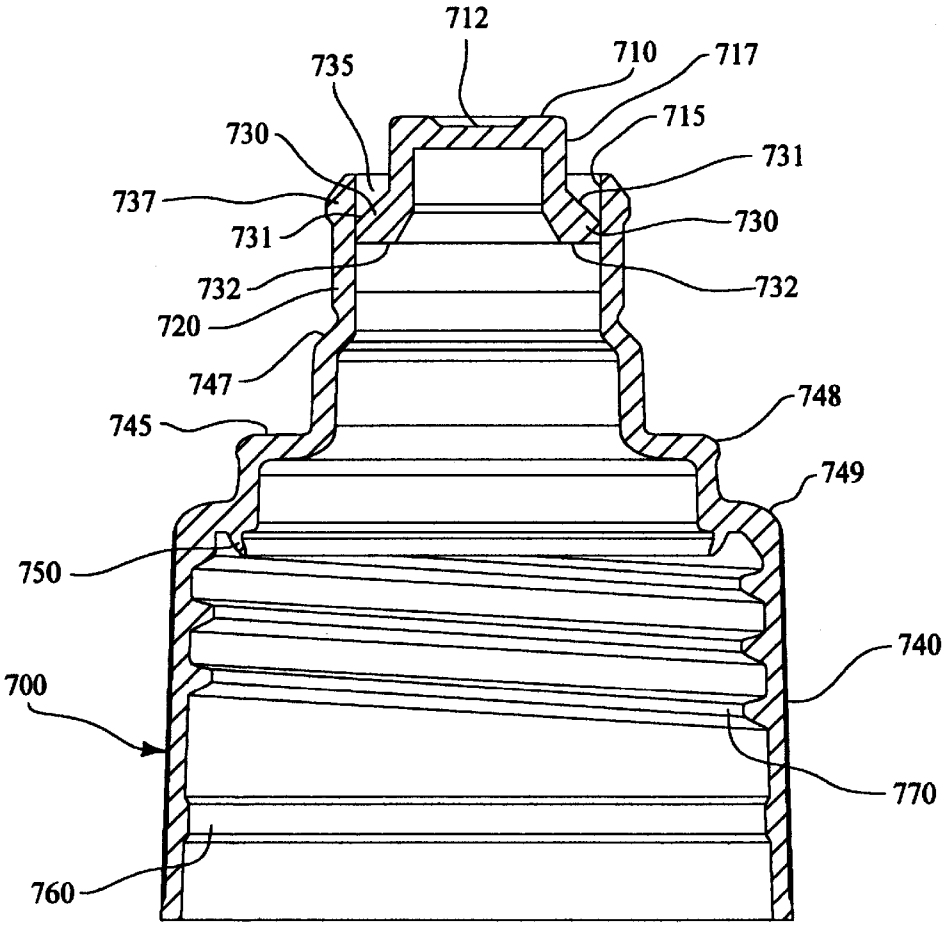
FIG. 2*f* is a cross-sectional view of still a further embodiment of the cap body of the three-piece closure of the present invention.

FIGS. 2*c*–2*f* show embodiments of the cap body that differ from that shown in FIGS. 2*a* and 2*b*. Namely, each embodiment of the cap body shown in FIGS. 2*c*–2*f* includes spokes having a shape that varies from that of the other embodiment, but all embodiments of the present invention include spokes that are aligned non-adjacently to the sealing bead 337 projecting from the side wall 315 of neck 320. Each spoke has a top surface and a bottom surface. As shown in FIG. 2*c,* spokes 432 include top surfaces 431 and bottom surfaces 432. Both top surfaces 431 and bottom surfaces 432 are aligned non-perpendicularly to side wall 315 of neck 320. The cap body 500, shown in FIG. 2*d,* has spokes 530 with top surfaces 531 and bottom surfaces 532 that are aligned differently than the surfaces of the spokes 430 of cap body 400. Namely, top surfaces 531 are aligned perpendicularly to side wall 515, while bottom surfaces 532 are aligned non-perpendicularly with the side wall 515. A third embodiment of the cap body 600, shown in FIG. 2*e,* includes spokes 630 that has both top surfaces 631 and bottom surfaces 632 aligned perpendicularly with side wall 615 of neck 620. Another embodiment of the cap body 700, shown in FIG. 2*f,* includes spokes 730 having top surfaces 731 that are aligned non-perpendicularly to side wall 715, while the bottom surfaces 732 are aligned perpendicularly therewith. Each embodiment of the spokes of the present invention provides attachment between the center post and the neck, while limiting the amount of structural plastic that is adjacent the sealing bead projecting from the neck of the cap body, thereby reducing the occurrence of sinks in the sealing bead and providing greater flexibility to the neck of the cap body.

Figure 3B:
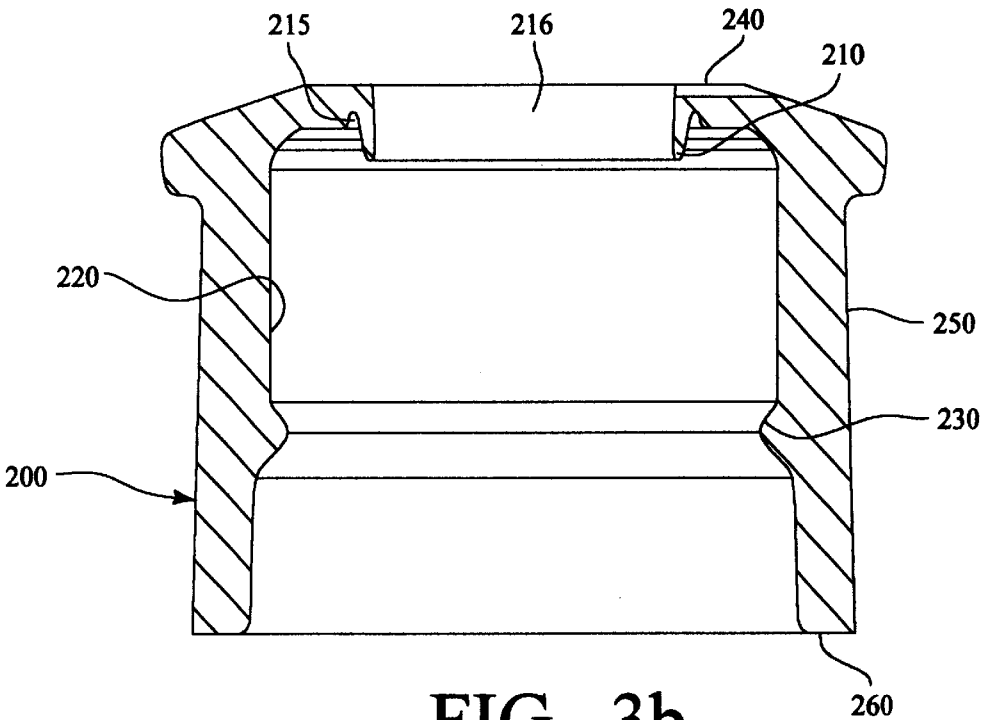
FIG. 3*b* is a cross-sectional view of a slider valve of the three-piece closure of the present invention taken along line 3*b*—3*b* of FIG. 3*a*.
Figure 3A:
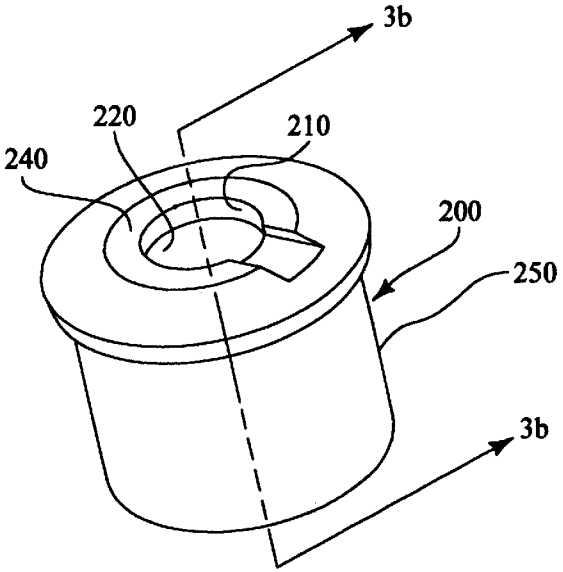
FIG. 3*a* is an upper perspective view of a slider valve of the three-piece closure of the present invention.

As shown in FIGS. 3*a* and 3*b,* the slider valve 200 has a first top wall 240, with a second axial opening 216 therein, and a second skirt 250 depending therefrom. An annular seal 210 depends from the first top wall 240. The first top wall 240 has an annular trough 215 disposed therein that circumscribes the annular seal 210. The annular trough 215 provides more flexibility to the annular seal 210 than would otherwise be exhibited by the seal in the absence of the trough. This increased flexibility provides for easier sealing of the closure when the slider valve 200 is pushed into the closed position. The second skirt 250 has a terminating edge

260 defining an open bottom end of the slider valve 200. A valve sealing bead 230 is provided along the inside surface of the second skirt 250 in order to prevent fluid leaks between the slider valve 200 and the cap body 300. The slider valve 200 is moveably attached to cap body 300 and may slide axially along the neck 320 of the cap body 300. The slider valve 200 may slide along a space defined at the lower and closed position by the contact area of the terminating edge 260 and the cap body shoulder 345 and at the upper and open position by the contact area of the valve sealing bead 230 and neck sealing bead 337. This range of motion further defines, in general, the closed and open positions, respectively, of the closure 10.

Figure 4B:
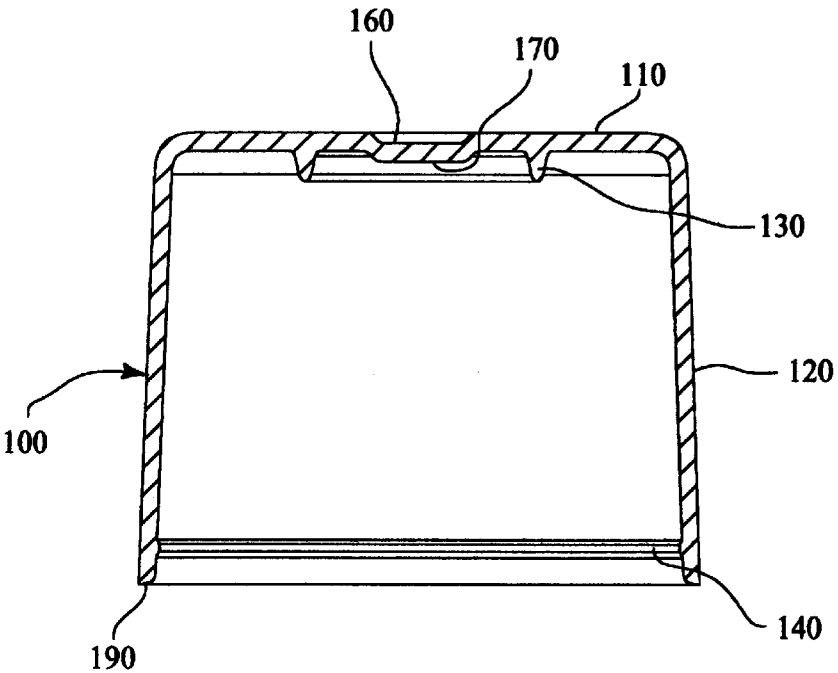
FIG. 4*b* is a cross-sectional view of an overcap of the three-piece closure of the present invention taken along line 4*b*—4*b* of FIG. 4*a*.
Figure 4A:
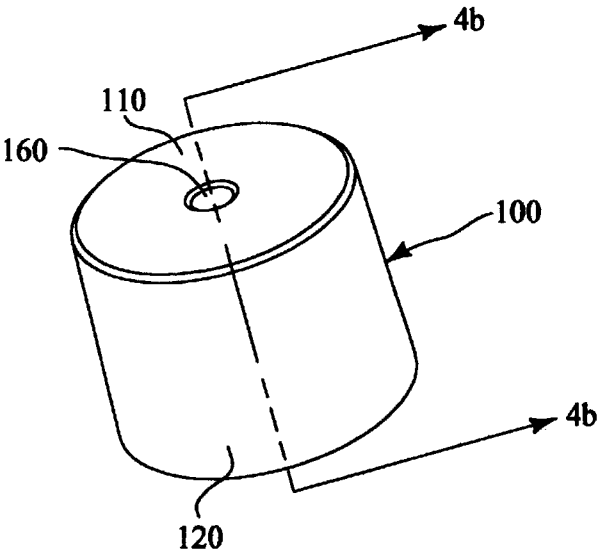
FIG. 4*a* is an upper perspective view of an overcap of the three-piece closure of the present invention.

FIGS. 4*a* and 4*b* show the overcap 100 of the present invention. A second top wall 110 is included on the overcap 100 with a third skirt 120 depending from this second top wall 110. This third skirt 120 terminates at edge 190 and defines an open bottom end of the overcap 100. A well 160 is formed in the second top wall 110 of the overcap 100. An annular ring 130 depends from second top wall 110. As discussed hereinafter, this annular ring 130 assists in the downward axial movement of the slider valve 200 of FIGS. 3*a* and 3*b* into a closed position when the overcap 100 is attached to cap body 300.

At the lower portion of the third skirt 120, a locking bead 140 projects therefrom. This locking bead 140 engages a corresponding outwardly projecting locking rib 348, located on the cap body 300, when the overcap 100 is attached to the cap body 300. When the user presses the overcap 100 downward, the locking bead 140 is forced to snap over the locking rib 348, thereby holding the overcap 100 in position on the cap body 300.

In use, the overcap 100 may be removed from the cap body 300 by disengaging the locking bead 140 from locking rib 348. Upward force may then be applied to slider valve 200 so as to slidably move it to the upward and open position. Fluid may then be dispensed from the container through the closure 10 via openings 315 in cap body 300 and axial opening 216 in the first top wall 240 of slider valve 200. In order to close the closure 10, downward force may be applied directly to slider valve 200, thereby moving it down to the lower and closed position defined by the contacting of the terminating edge 260 and the cap body shoulder 345. Alternatively, overcap 100 may be placed on cap body 300 when slider valve 200 is in the open position. As overcap 100 is placed on cap body 300, annular ring 130 engages the first top wall 240 of slider valve 200. As downward force is applied to overcap 100, the annular ring 130 forces slider valve 200 downwards toward the closed position. In order for locking bead 140 of overcap 100 to engage locking rib 348 of cap body 300, slider valve 200 must necessarily be in the closed position. Therefore, when overcap 100 is forced down over cap body 300 to attach thereto by the engagement of locking bead 140 with locking rib 348, slider valve 200 is necessarily in the closed position. Thus, the user of the closure 10 is assured of the dispenser being closed and sealed when the overcap 100 is attached to the cap body.

When a closure 10 of this type is molded utilizing plastic in standard injection molding techniques, the plastic retains heat introduced during the molding process in direct proportion to the thickness of the plastic. As a result of this tendency for plastic to retain heat, the closure of the present invention has been provided with the plurality of spokes 330 being molded so as to not be adjacent to the neck sealing bead 337. The non adjacent alignment of the spokes 330 and the neck sealing bead 337 reduces the retained heat that would otherwise be present if these features were molded adjacent to each other. Thus, the likelihood leakage of the closure 10 due to sinks in the neck sealing bead 337 is reduced by aligning the spokes in non-adjacent positions relative to the neck sealing bead.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A resealable push/pull type closure comprising:

a cap body having a neck, said neck having a first axial opening therein and a neck sealing bead projecting outwardly therefrom, said neck having a shoulder flaring outwardly therefrom, a first skirt depending from said shoulder, a center post mounted axially within said first axial opening of said neck by a plurality of spokes attached to said neck, said plurality of spokes displaced horizontally from said sealing bead along a longitudinal axis of said first axial opening.

2. The closure of claim 2, said cap body including a locking rib extending outwardly therefrom.

3. The closure of claim 1, further comprising a slider valve moveably attached to said cap body, said slider valve having a first top wall, said first top wall having a second axial opening therein and a second skirt depending therefrom, said first top wall also having an annular seal depending therefrom, said annular seal circumscribed by an annular trough disposed within said first top wall.

4. The closure of claim 2, further comprising an overcap releasably attached to said cap body, said overcap having a second top wall with a third skirt depending therefrom, said second top wall having an annular ring depending therefrom, wherein said annular ring engages said second top wall of said slider valve when said overcap is attached to said cap body, said third skirt having a locking bead projecting therefrom, wherein said locking bead engages said locking rib when said overcap is attached to said cap body, said slider valve being restrained in a closed position when said locking bead engages said locking rib.

5. The closure of claim 1, said cap body including a linerless seal projecting therefrom.

6. The closure of claim 1, said first skirt including at least one thread projecting inwardly therefrom.

7. The closure of claim 1, said central post extending beyond said neck.

8. The closure of claim 1, said first skirt having a centering bead projecting inwardly therefrom.

9. The closure of claim 1, said plurality of spokes including at least at least one spoke having a top surface and a bottom surface, said top surface and said bottom surface being aligned perpendicularly to a side wall of said neck.

10. The closure of claim 1, said plurality of spokes including at least one spoke having a top surface and a bottom surface, said top surface being aligned perpendicularly to a side wall of said neck, and said bottom surface being aligned non-perpendicularly to said neck.

11. The closure of claim 1, said plurality of spokes including at least one spoke having a top surface and a bottom surface, said top surface and said bottom surface being aligned non-perpendicularly to said neck.

12. A resealable push/pull type closure comprising:

a cap body having a neck, said neck having a first axial opening therein and a neck sealing bead projecting outwardly therefrom, said neck having a shoulder flaring outwardly therefrom, a first skirt depending from said shoulder, a center post mounted axially within said first axial opening of said neck by a plurality of spokes attached to said neck, said plurality of spokes displaced horizontally from said sealing bead along a longitudinal axis of said first axial opening; and, a slider valve moveably attached to said cap body, said slider valve having a first top wall, said first top wall having a second axial opening therein and a second skirt depending therefrom, said first top wall also having an annular seal depending therefrom, said annular seal circumscribed by an annular trough disposed within said first top wall.

13. The closure of claim 12, further comprising an overcap releasably attached to said cap body, said overcap having a second top wall with a third skirt depending therefrom, said second top wall having an annular ring depending therefrom, wherein said annular ring engages said second top wall of said slider valve when said overcap is attached to said cap body, said third skirt having a locking bead projecting therefrom, wherein said locking bead engages a locking rib extending outwardly from said cap body when said overcap is attached to said cap body, said slider valve being restrained in a closed position when said locking bead engages said locking rib.

14. The closure of claim 12, said cap body including a linerless seal projecting therefrom.

15. The closure of claim 12, said first skirt including at least one thread projecting inwardly therefrom.

16. The closure of claim 12, said central post extending beyond said neck.

17. The closure of claim 12, said first skirt having a centering bead projecting inwardly therefrom.

18. The closure of claim 12, said plurality of spokes including at least at least one spoke having a top surface and a bottom surface, said top surface and said bottom surface being aligned perpendicularly to a side wall of said neck.

19. The closure of claim 12, said plurality of spokes including at least one spoke having a top surface and a bottom surface, said top surface being aligned perpendicularly to a side wall of said neck, and said bottom surface being aligned non-perpendicularly to said neck.

20. The closure of claim 12, said plurality of spokes including at least one spoke having a top surface and a bottom surface, said top surface and said bottom surface being aligned non-perpendicularly to said neck.

21. A resealable push/pull type closure comprising:

a cap body having a neck, said neck having a first axial opening therein and a neck sealing bead projecting outwardly therefrom, said neck having a shoulder flaring outwardly therefrom, a first skirt depending from said shoulder, a locking rib extending outwardly from said cap body, a center post mounted axially within said first axial opening of said neck by a plurality of spokes attached to said neck, said plurality of spokes displaced horizontally from said sealing bead along a longitudinal axis of said first axial opening;

a slider valve moveably attached to said cap body, said slider valve having a first top wall, said first top wall having a second axial opening therein and a second skirt depending therefrom, said first top wall also having an annular seal depending therefrom, said annular seal circumscribed by an annular trough disposed within said first top wall; and, an overcap releasably attached to said cap body, said overcap having a second top wall with a third skirt depending therefrom, said second top wall having an annular ring depending therefrom, wherein said annular ring engages said second top wall of said slider valve when said overcap is attached to said cap body, said third skirt having a locking bead projecting therefrom, wherein said locking bead engages said locking rib when said overcap is attached to said cap body, said slider valve being restrained in a closed position when said locking bead engages said locking rib.

22. The closure of claim 21, said cap body including a linerless seal projecting therefrom.

23. The closure of claim 21, said first skirt including at least one thread projecting inwardly therefrom.

24. The closure of claim 21, said central post extending beyond said neck.

25. The closure of claim 21, said first skirt having a centering bead projecting inwardly therefrom.

26. The closure of claim 21, said plurality of spokes including at least at least one spoke having a top surface and a bottom surface, said top surface and said bottom surface being aligned perpendicularly to a side wall of said neck.

27. The closure of claim 21, said plurality of spokes including at least one spoke having a top surface and a bottom surface, said top surface being aligned perpendicularly to a side wall of said neck, and said bottom surface being aligned non-perpendicularly to said neck.

28. The closure of claim 21, said plurality of spokes including at least one spoke having a top surface and a bottom surface, said top surface and said bottom surface being aligned non-perpendicularly to said neck.

29. A resealable closure comprising:

a cap body having a neck, said neck having a centrally formed axial opening therein and a neck sealing bead projecting outwardly from said neck, said neck having a lower portion with a shoulder flaring outwardly therefrom;

a center post mounted axially on an internal wall of said centrally formed axial opening of said neck by a plurality of spokes attached to said internal wall;

said plurality of spokes displaced horizontally from said sealing bead along a longitudinal axis of said centrally formed axial opening;

a slider valve vertically moveable on said neck, said slider valve having a top wall with an axial opening therein.

* * * * *

UNITED STATES PATENT AND TRADEMARK OFFICE

CERTIFICATE OF CORRECTION

PATENT NO. : 6,286,733 B1
DATED : September 11, 2001
INVENTOR(S) : Francois

It is certified that error appears in the above-identified patent and that said Letters Patent is hereby corrected as shown below:

Title page,
Item [73], Assignee, change “ID” to -- IN --;

Column 3,
Line 41, change “cab” to -- cap --;
Line 41, change “200” to -- 300 --;

Column 4,
Line 35, change “432” to -- 430 --;

Column 6,
Line 23, change “2” to -- 1 --;
Line 52, delete the second occurrence of -- at least --;

Column 7,
Line 35, delete the second occurrence of -- at least --;

Column 8,
Line 29, delete the second occurrence of -- at least --.

Signed and Sealed this

Twenty-fourth Day of September, 2002

*Attest:*

*Attesting Officer*

JAMES E. ROGAN
*Director of the United States Patent and Trademark Office*